US008536434B2

(12) United States Patent
Ruffino

(10) Patent No.: US 8,536,434 B2
(45) Date of Patent: Sep. 17, 2013

(54) RETROFIT KIT AND METHOD FOR TUNING AND MIKING RESONANT SIDE DRUMHEAD

(76) Inventor: William E. Ruffino, Agua Dulce, CA (US)

( * ) Notice: Subject to any disclaimer, the term of this patent is extended or adjusted under 35 U.S.C. 154(b) by 29 days.

(21) Appl. No.: 13/396,013

(22) Filed: Feb. 14, 2012

(65) Prior Publication Data

US 2012/0167745 A1 Jul. 5, 2012

Related U.S. Application Data

(63) Continuation-in-part of application No. 12/249,693, filed on Oct. 10, 2008, now abandoned.

(60) Provisional application No. 60/981,068, filed on Oct. 18, 2007.

(51) Int. Cl.
*G10D 13/02* (2006.01)

(52) U.S. Cl.
USPC ..... 84/414; 84/411 R

(58) Field of Classification Search
USPC ..... 84/414, 411 M, 411 R
See application file for complete search history.

(56) References Cited

U.S. PATENT DOCUMENTS

| | | | | |
|---|---|---|---|---|
| 4,254,685 | A | 3/1981 | Rose | |
| 4,589,323 | A | 5/1986 | Belli et al. | |
| 4,745,839 | A | 5/1988 | Peraino | |
| 4,805,514 | A | 2/1989 | Billings | |
| 5,361,669 | A | 11/1994 | Genna | |
| 6,172,289 | B1 | 1/2001 | Shelley | |
| 6,700,044 | B1 | 3/2004 | Bencomo | |
| 7,560,632 | B1 | 7/2009 | Lanzel et al. | |
| 2001/0001684 | A1 | 5/2001 | Sylvester | |
| 2007/0116323 | A1 * | 5/2007 | Hikichi | 381/396 |
| 2007/0121993 | A1 * | 5/2007 | Horigome et al. | 381/396 |
| 2007/0201718 | A1 * | 8/2007 | Shimoe et al. | 381/396 |

OTHER PUBLICATIONS

Bernhard Castiglioni, Drummerworld Official Discussion Forum, internet discussion forum, Jul. 26, 2006, http://www.drummerworld.com/forums/showthread.php?t=15883.

Thomas Antoine, Roomboom Drum, internet document, Oct. 1, 2004, http://nvh-engineer.chez-alice.fr/.

Thunderhead, Internet document, Jul. 26, 2006, http://www.drummerworld.com/forums/showthread.php?t=15883.

* cited by examiner

*Primary Examiner* — Jianchun Qin
(74) *Attorney, Agent, or Firm* — Berenato & White, LLC

(57) ABSTRACT

The resonant drum head mounted speaker cone retrofit kit improves the sound of the drum on audio recordings and in live sound situations and changes the way the drum is miked in live and studio applications. The center of the resonant drumhead is cut out and a speaker cone assembly is attached thereon facing outwards. The speaker cone, which also vibrates from this pressure, now becomes the miked surface of the instrument. Using otherwise conventional miking techniques, a wider range of attack and tone characteristics can be obtained from the drumhead. Additionally, use of optional speaker cone sizing, composition options and differences in tension also contribute to define and tune the sound characteristics based on end user preference.

6 Claims, 5 Drawing Sheets

PLASTIC RETAINER RING FOR DUST CAP
FIG 6A CROSS SECTION
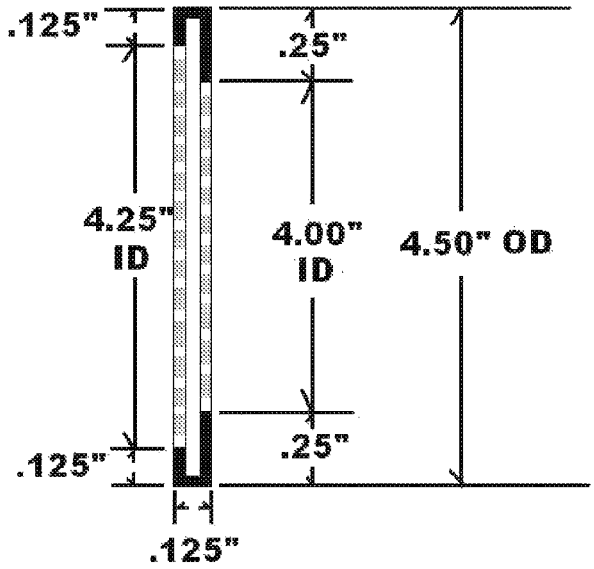
FIG 6B TOP VIEW
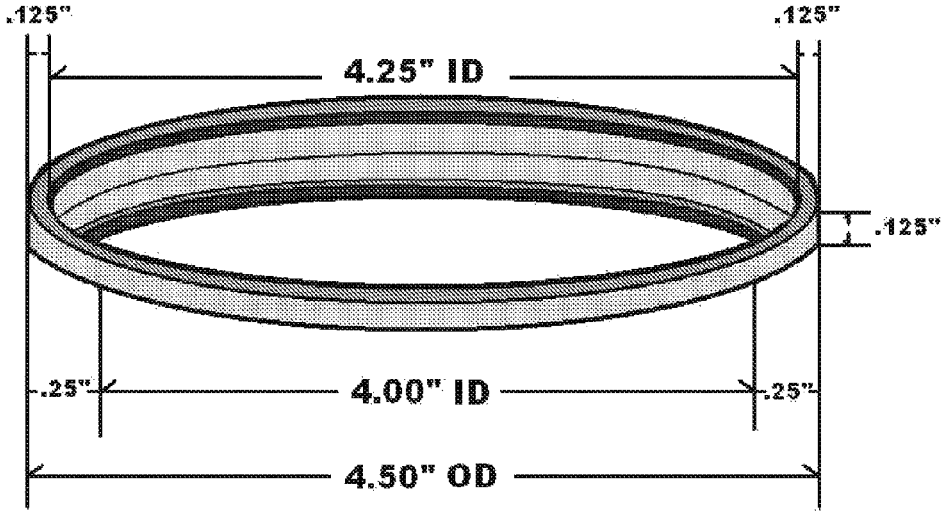

RETROFIT KIT AND METHOD FOR TUNING AND MIKING RESONANT SIDE DRUMHEAD

This application is a continuation-in-part of application Ser. No. 12/249,693, filed Oct. 10, 2008 (now abandoned), which application claims the benefit of U.S. Provisional filing 60/981,068, flied Oct. 18, 2007.

BACKGROUND OF THE INVENTION

1. Field of the Invention

The invention relates generally to a special resonant side drumhead add-on/retrofit kit and method for live and studio miking applications where the sounds of the drum can be tuned to match a desired sound and response profile.

2. Background

In the past, there has been a standard way of placing microphones on a drum kit in order to get a desired sound. This mainly involves placing microphones over the batter side drumhead to pick up the attack and tone characteristics of the drum when played. Care with this placement must be taken so as to not interfere with the player and to prevent the microphones from being hit and damaged and from producing undesirable popping sounds. Isolation is also an issue as this microphone placement also picks up unwanted sounds from cymbals and other drums, otherwise known as "bleed through". For the bass drum in particular, it was found that cutting a hole in the resonant side drum head was needed to allow for closer microphone placement and better shielding from bleed through.

With the current invention, these aspects of microphone placement change, as all the drums can now be miked from the resonant side head, opposite from the player. The speaker aspect of the invention is derived from the techniques used in microphone placement on guitar and bass amplifiers, where the microphone is placed at the speaker cone and depending on the angle of the microphone to the speaker, either a brighter or fuller sound is picked up. Translating this to the drum, the placement of the microphone also allows for an interesting range of attack and tone, as the speaker translates the sound better than the normal resonant side drumhead which is typically never used for miking purposes.

Currently there are no resonant head devices offered for the other drums. The current invention offers the same capabilities as afforded the bass drum in reference to operation, miking and sound tuning.

SUMMARY OF THE INVENTION

The present invention advantageously fills the aforementioned deficiencies by providing a special resonant side drumhead add-on/retrofit kit for live and studio miking applications.

The present invention relates to a special resonant side drumhead add-on/retrofit kit which is made up of the following required elements: (1) a specially designed speaker cone, (2) a speaker surround, (3) a pressure sensitive adhesive stiffening gasket and (4) a ported dust cap. These elements are connected as follows: The speaker cone, of a specified material, will have a speaker surround already bonded to it. The surround will have an oversized outer edge in which the back side of it is bonded by a pressure sensitive adhesive or "PSA" to a stiffening gasket with an outside diameter and width equal to that of the speaker surround edge. The other side of the gasket is also coated with PSA and then covered with a removable paper backing (becoming what is known as "Peel and Stick") to be utilized by the end user. An integrated channel molded into the voice coil opening at the back of the cone will provide for a removable ported dust cap. The voice coil opening is varied; based on the size of the speaker cone chosen. An optional plastic retainer ring may be glued inside the integrated channel to better hold the ported dust cap in place.

Using a provided template, the end user makes a cutout in the resonant drumhead approximately one inch in diameter smaller than the overall speaker assembly. The Peel and Stick (PSA) backing paper is removed from the speaker cone assembly; centered over the cutout and pressed onto the outside wall of the resonant drumhead with the hoop side facing up and with the back side of the cone sticking upwards as well (which will be inwardly oriented with respect to the drum when re-assembled).

The drumhead is re-mounted to the resonant side of the drum with the speaker cone facing outwards and tightened evenly to the drum without wrinkles. The stiffening gasket enables ordinary tensioning of the drumhead now equipped with the speaker cone. A microphone is pointed towards the "speaker" of the drum. When the batter side of the drum is hit, the internal air pressure generated causes the resonant side head and speaker assembly to vibrate, therefore transferring the sound of the drum to be picked up by the microphone. Several factors help to determine the attack and tone characteristics of the drum such as: a) the placement of the microphone at the speaker cone, b) the amount of tension placed on the resonant head and speaker assembly, c) use of alternately sized speaker assemblies, d) different composition options available for the speaker assemblies, and e) use of the removable ported dust cap.

It should be further noted that (a) the cone can be made of various materials, such as but not limited to polypropylene, plastics, Kevlar, Mylar, aluminum (or any other metal or metal alloy) hemp, cloth or any combination of these elements but molded paper or cardboard is preferable, (b) the speaker surround or webbing can be made of cardboard, coated cardboard, polyurethane, butyl rubber, foam rubber, or rubber, but cloth is preferable, (c) The stiffening gasket can be made of various materials such as but not limited to plastics, metals, fiberglass, chipboard or cardboard and can be of varied dimensions dependant on the size of the speaker cone, although a finished width of at least 1 inch with a thickness of at least 0.40 inches is preferable, (d) The gasket is bonded to the back side of the surround edge of the speaker using a pressure sensitive adhesive by various means, such as but not limited to the use recommended by the manufacturer and may be sprayed, rolled or painted on, (e) the removable dust cap can be made of various materials, such as but not limited to cardboard, coated cardboard, plastics, cloth, aluminum (or any other metal or metal alloy) but a cloth mesh is preferable. The dust cap primarily functions to obscure the hole in the center of the speaker. The characterization that dust cap is ported is such that air should pass reasonably freely through the dust cap. Hence, a woven mesh is preferred.

Presently, miking a drum kit involves careful placement of the microphones near enough to the drum to pick up the sound, but not so as to get in the way of the player or pick up too much extraneous sound known as "bleed through". There is always a compromise in placement due to the issue of the microphone getting hit while playing, causing undesirable sounds in live sound or recordings. Also, while a resonant side drumhead is essential to the tone of the drum, it is never used for miking except for the bass drum, wherein the head is either removed completely or a hole cut into it to allow closer microphone access or the insertion of various sound dampening materials.

This invention changes this method of miking. Firstly, the sound of the drum is picked up from the resonant side head—away from the player and shielded from bleed through. In a live performance, this is the drum sound heard by the listener inasmuch as the resonant drum head(s) are oriented toward the audience is some respect. However, with the present invention, microphone placement now depends on preference, not convenience. It is known, for tuning purposes, that on-axis miking will bring out a brighter attack sound, while an off-axis miking will accentuate a rounder tone.

Typically, a speakers' surround tension is fixed. In this application it can be varied and depending on tension, a "tuned" dampening effect is created on the lower or "sub" frequencies produced by the drum. The greater the tension, the greater the dampening, thus effectively tuning the drum as a regular resonant head would normally do The end user "tuner" will also have options in sizes and speaker composition to choose from, as the different speaker sizes and material compositions accentuate different tonal ranges of the drum. Typically, using a hard material like aluminum for the speaker assembly will reproduce a brighter tone than using cardboard, which gives a more rounded tone. A larger speaker assembly will produce a deeper tone than a smaller assembly which will allow for a punchier sound. There are no other known resonant head add-on/retrofit devices that offer these choices or abilities.

A standard Mylar resonant head is itself a speaker. It does, in fact, transmit vibration. But, no other resonant drum head add-on/retrofit kit uses an integrated tuneable speaker cone assembly as does the present invention to reproduce the drum sound wherein the drum can now be miked and tuned from the resonant side head instead of the batter side.

All other inventions try to change the sound of the drum by either muffling or removing overtones—this invention utilizes all the natural sounds of the drum because the tone that is picked up by the microphone is coming through the drum shell where the tonal characteristics are determined.

No other resonant drumhead add-on/retrofit kit will have as many options to customize and tune a drum's sound.

The sound principle behind this is, for any given enclosure, there is a resonant frequency or tone. Prior art which includes speaker cabinet building uses these principles. By selecting the proper size speaker for a given enclosure—certain tonal frequencies can be enhanced. This is known as "tuning". Relating this to the drum enclosure, the drum can also be "tuned" by utilizing the size and composition options of the invention as well as the amount of tension placed on it.

Sound is a relative thing—it is different to different listeners. This invention is an option available for not only drummers but also for sound engineers to achieve a particular sound from the drum that is completely new. It is also an opportunity to completely change the way drums are miked in live and studio applications that is less cumbersome for both parties. As noted previously, presently drums need to be miked from the batter side which often interferes with the player and introduces the possibilities of unwanted pops on recordings or even damage to the microphones themselves when they are accidentally hit. Isolation is also problematic as microphone placement yields unwanted sounds from nearby cymbals and other drums, otherwise known as "bleed through". By miking the resonant side drum heads, there is no interference with the player, the drum sound is improved and bleed through is greatly reduced.

Finally, it is an object of the present invention to provide a special resonant side drumhead add-on/retrofit kit for live and studio miking applications that do not suffer from any of the problems or deficiencies associated with prior solutions.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

FIG. 6A Is a cross section view of the optional plastic retainer ring

FIG. 6B Is a top view of the optional plastic retainer ring

DETAILED DESCRIPTION OF THE INVENTION

Figure 1:
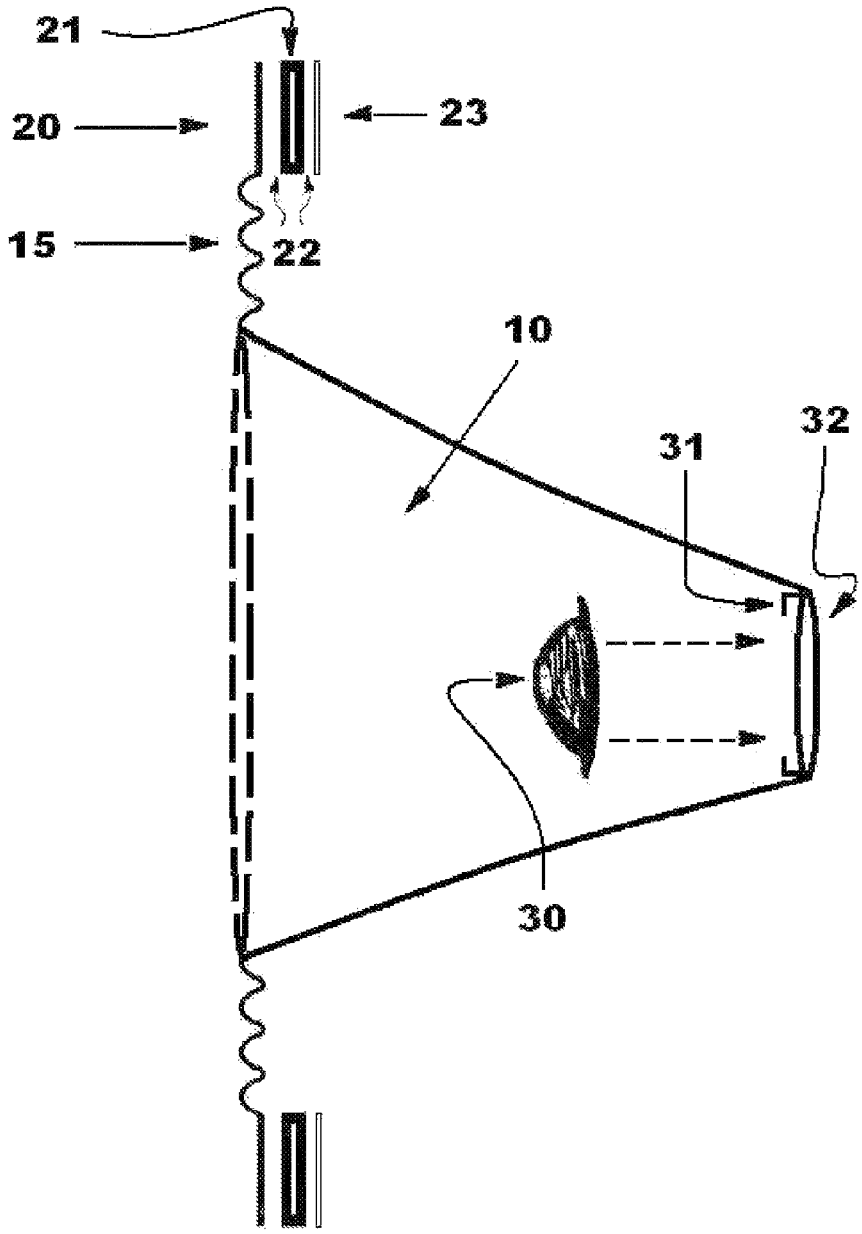
FIG. 1 Is an exploded view of the components making up the invention
Figure 2:
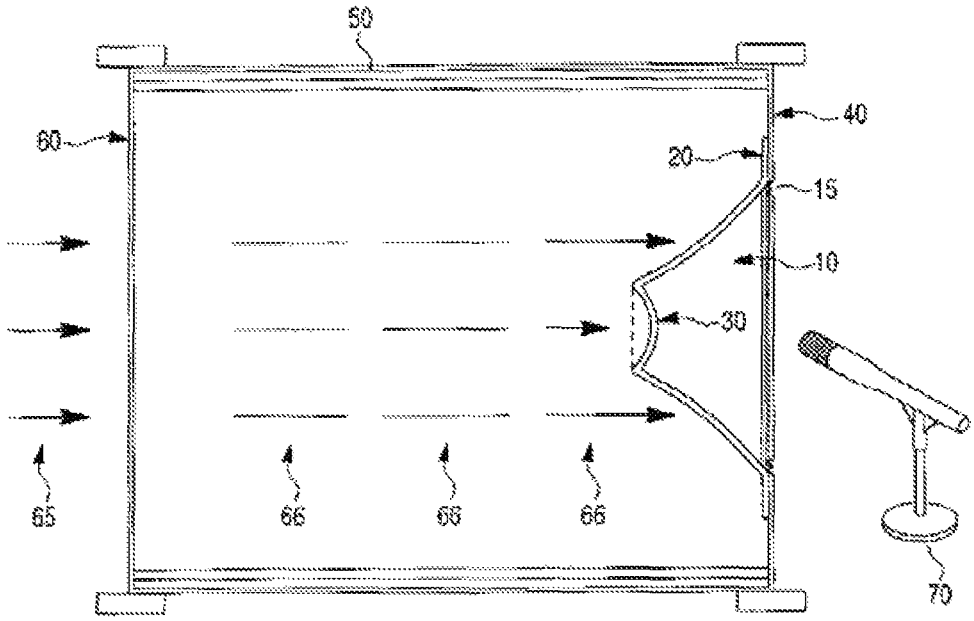
FIG. 2 Is a cross section view showing the principle behind the invention
Figure 3:
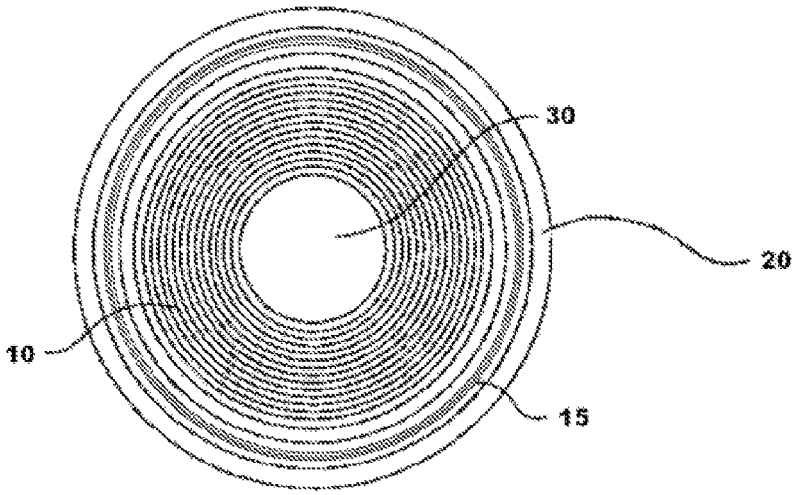
FIG. 3 Is a perspective drawing of the invention from the front
Figure 4:
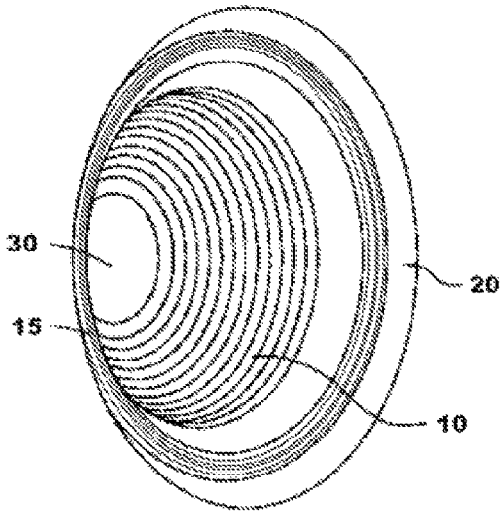
FIG. 4 Is a perspective drawing of the invention from the back
Figure 5:
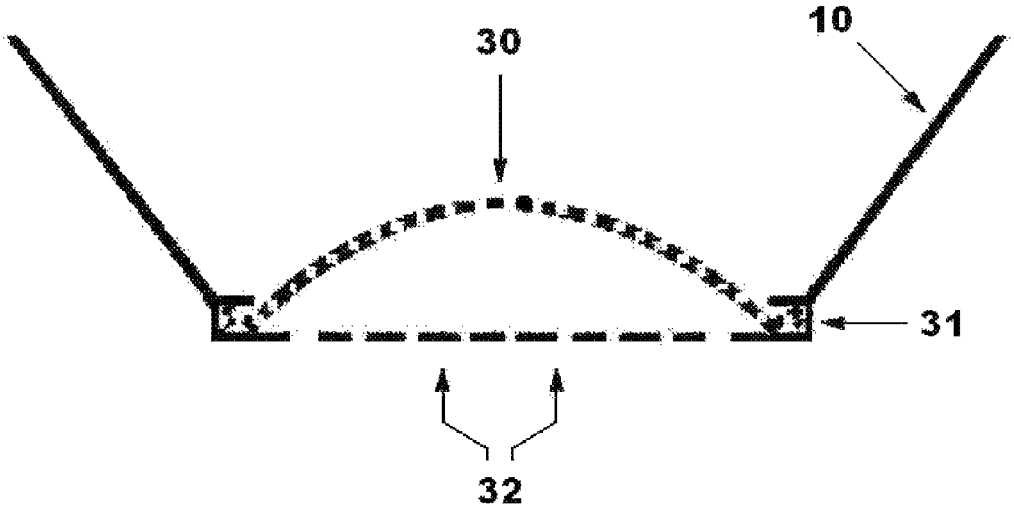
FIG. 5 Is a detailed view of the dust cap and integrated channel

The present invention relates to a special resonant side drumhead add-on/retrofit kit made up of the following required elements: (1) a specially designed speaker cone, (2) a speaker surround, (3) a pressure sensitive adhesive stiffening gasket and (4) a dust cap. These elements are connected as follows (with reference to the drawing Figures): A specially designed speaker cone (10) with a specially molded integrated channel (31) at the back of the voice coil opening (32) has bonded to it a surround (15) that has an oversized edge (20). A stiffening gasket (21) with a diameter and width equal to the surround edge (20) is bonded to the back side of the surround using pressure sensitive adhesive (22). The other side of the gasket is also coated with pressure sensitive adhesive and will have backing paper (23) applied to it creating a "Peel and Stick" surface used during installation by the end user. The entire assembly is trimmed to size. A standard type cloth dust cap (30) is then fitted inside the integrated channel (31)

Furthermore, this invention may have one or more of the following: (1) different material compositions of the speaker cone and dust cap, such as but not limited to polypropylene, plastics, Kevlar, Mylar, aluminum (or any other metal or metal alloy), hemp, cloth or any combination of these elements; (2) different material compositions of the speaker surround such as cardboard, coated cardboard, polyurethane, foam rubber, or rubber, (3) different material compositions of the pressure sensitive adhesive (PSA) gasket such as plastics, metals, fiberglass, chipboard or cardboard, (4) a plastic retainer ring for the dust cap (see FIG. 6) that may be glued into the integrated channel (31) to help hold the dust cap.

When the batter side drumhead 60 is struck, the generated internal air pressure waves 65 travel through the drum where they contact the resonant side head 40 and the attached speaker cone assembly 10. The speaker surround, which is flexible, allows the speaker cone assembly to vibrate and transmit the sound exteriorly of the drum 50. Placement of the microphone 70 in relation to the speaker cone 10 provides for a wide range of attack and tone as it is well known that microphone placement on-axis to the speaker picks up a brighter sound, while an off-axis placement picks up a warmer sound. Based on individual preference, size and composition options of the speaker assemblies accentuate differences in the tonal range of the drum. The removable dust cap further enables the ability to close mic the drum by allowing the microphone to be placed through the voice coil opening without interfering with the normal operation of the assembly.

The end user will first select a predetermined size of speaker cone to mount to a specified drum. The speaker cone can be as small as ⅓ to ½ (33-50%) of the overall diameter of the drumhead or almost the same diameter (90%+) of the drumhead, but with sufficient room remaining to cut a hole and mount and tension the resonant drumhead, now equipped with a speaker cone and stiffening gasket, to the drum frame. The largest relative size of the speakercone would preferably leave a 1½ to 2 inch overall diameter dimension difference to the overall diameter of the drumhead being retrofit. The size limitation, as noted, being sufficient room to attach the speaker cone and still have a tensionable (i.e., tuneable) drumhead following the retrofit.

The end user will then cut the hole in the resonant head, then remove the peel and stick backing from the speaker assembly and affix it to the outside of the drum head and thusly attach the speaker cone surround. In this manner, the end user can utilize the invention on whatever drumhead necessary without having to seek out a drum head already so equipped. Instead, a user can locate a suitable drum of any sort and retro-fit the system as desired and, thusly, "tune" the miked sound of the drum according to the sound requirement of the music being recorded. Drum sounds can be brightened, sharpened, dulled, mellowed, etc., using this kit and tuning methods available via material selection, tension, relative size to overall drumhead, and mike placement.

As noted, several factors help to determine the attack and tone characteristics of the drum such as: a) the placement of the microphone at the speaker cone, b) the amount of tension placed on the resonant head and speaker assembly, c) use of alternately or varied sized speaker cone assemblies, d) different composition options, from metallic to cardboard, etc., available for the speaker assemblies, and e) use of the removable adjustably ported dust cap. Hence, tuning in accord with the present method involves tension adjustment, wherein the resonant side drum head, post retrofit is tightened and loosened as in ordinary use, but now it affects the sound of the transmitted vibration of the cone. Typically, a speakers' surround tension is fixed. In this application it can be varied and depending on tension, a dampening effect is created on the lower or "sub" frequencies produced by the drum. The greater the tension, the greater the dampening, thus effectively tuning the drum as a regular resonant head would normally do.

The end user will also have options in sizes and speaker composition to choose from, as the different speaker sizes and material compositions accentuate different tonal ranges of the drum. Typically, using a hard material like aluminum for the speaker assembly will reproduce a brighter tone than using cardboard, which gives a more rounded tone. A larger speaker assembly will produce a deeper tone than a smaller assembly which will allow for a punchier sound. Selecting a stiffer cone, as opposed to softer cone material sharpens and shortens the tones, whereas a softer more malleable material subdues and lengthens the tone. The sizing relative to the drumhead also changes the tone, a smaller relative size of cone to drumhead brightens tones, a larger size cone relative to drumhead tends to soften tones. Lastly, the aperture(s) of the ported dust cap can be used to control pressure within the drum and the consequent transfer energy via compression from the batter head to the backside of the cone.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims It is indeed intended that the scope of the invention should be determined by proper interpretation and construction of the appended claims and their legal equivalents, as understood by those of skill in the art relying upon the disclosure in this specification and the attached drawings.

The invention claimed is:

1. A resonant drum head retrofit kit, adapted for assembly onto a drum opposite a batter head thereof, comprising:

speaker cone means, for transmitting vibration received against said speaker cone, said speaker cone means having an inner open dust cap end and an outer open forward end including a circular speaker surround, said forward end also including a stiffening gasket attached around a perimeter of said surround;

said speaker cone means adapted for assembly to a circular resonant drum head membrane having an inwardly oriented surface and an outwardly oriented surface and having a centrally located hole cut therethrough;

said forward end of said speaker being sealingly attached to an outer surface of said resonant drum head membrane via said stiffening gasket and completely surrounding said hole;

a dust cap means for closing off said inner dust cap end of said speaker cone means, said dust cap means being retained in said speaker cone in an annular channel mounted around said inner dust cap end of said speaker cone by a retainer ring;

said speaker cone equipped drumhead adapted for re-attachment to and tensioning upon a drum to a predetermined tension owing to a tuning characteristic desired by a kit user;

whereby, when said resonant drum head is assembled to said drum opposite said batter head, vibration and resulting sound from said batter head being struck is transmitted to said speaker cone via air pressure within said drum and is transmitted exteriorly of said drum and emitted sound therefrom can be altered in terms of tone by tension on the drumhead, wherein an increase in tension dampens the transmitted vibration.

2. A resonant drum head kit as in claim 1, wherein:

the overall sound emitted by the kit can be predetermined by selecting a specified speakercone material wherein a harder stiffer material brightens tones and a softer material mellows tones.

3. A resonant drum head kit as in claim 1, wherein:

the overall sound emitted by the kit can be altered by selecting a diameter speaker cone means relative to said drum head in a range of 33-90% of the overall drumhead diameter.

4. A resonant drum head kit as in claim 1, wherein:

said attachment of said forward end of said speaker cone means to said inner surface is accomplished using a peel and stick glue system.

5. A resonant drum head as in claim 1, wherein:

said speaker cone means is 50-85% of the overall diameter of said resonant drum head.

6. A method of tuning a drum sound, comprising:

selecting a drum shell having one end closed in by a batter head, and an opposite end closed in by a resonant drum head, said resonant drum head membrane having an inwardly oriented surface and an outwardly oriented surface;

removing said resonant side drum head;

selecting a speaker cone means, made of specified material according to a desired tuning characteristic of a user, for transmitting vibration received against said speaker cone, said speaker cone means having an inner dust cap end and an outer forward end connecting to a speaker surround and stiffening gasket, and being sized in overall diameter in the range of 33-90% of said resonant side drum head;

cutting a centrally located hole in said resonant side drumhead to approximately match an outer dimension of a forward end of said speaker cone means and smaller than said stiffening gasket;

sealingly attaching said stiffening gasket to an outer surface of said resonant drum head membrane and completely surrounding said hole;

mounting a dust cap means for closing off said inner dust cap end of said speaker cone means to said speaker cone means, said dust cap means being retained in said speaker cone in an annular channel mounted around said inner dust cap end of said speaker cone by a retainer ring;

remounting said resonant side drumhead to said drum shell;

tensioning said speakercone means equipped drumhead on said shell;

whereby, vibration and sound from said batter head being struck is transmitted to said speaker cone via air pressure within said drum and passed exteriorly of said drum and said sound can be changed in tone by changing a tension of said resonant side drum head.

* * * * *